US007610887B2

(12) United States Patent
Spath

(10) Patent No.: US 7,610,887 B2
(45) Date of Patent: Nov. 3, 2009

(54) VALVE-DEACTIVATING HYDRAULIC LIFTER HAVING A CONTOURED PIN HOUSING BOTTOM SURFACE

(75) Inventor: Mark J. Spath, Spencerport, NY (US)

(73) Assignee: Delphi Technologies, Inc., Troy, MI (US)

( * ) Notice: Subject to any disclaimer, the term of this patent is extended or adjusted under 35 U.S.C. 154(b) by 96 days.

(21) Appl. No.: 11/820,756

(22) Filed: Jun. 20, 2007

(65) Prior Publication Data

US 2008/0314343 A1 Dec. 25, 2008

(51) Int. Cl.
*F01L 1/14* (2006.01)

(52) U.S. Cl. ..... 123/90.48; 123/90.45; 123/90.52; 74/569

(58) Field of Classification Search ..... 123/90.48, 123/90.52, 90.55, 90.44, 90.45, 90.46, 90.6, 123/90.61; 74/567, 569
See application file for complete search history.

(56) References Cited

U.S. PATENT DOCUMENTS 6,497,207 B2 12/2002 Spath et al.
6,578,535 B2 * 6/2003 Spath et al. ..... 123/90.16
6,802,288 B2 10/2004 Spath
6,814,040 B2 11/2004 Hendriksma et al.
6,920,857 B2 7/2005 Spath
6,976,463 B2 12/2005 Spath et al.
7,207,303 B2 * 4/2007 Geyer et al. ..... 123/90.55

* cited by examiner

*Primary Examiner*—Ching Chang
(74) *Attorney, Agent, or Firm*—Thomas N. Twomey

(57) ABSTRACT

A valve-deactivation hydraulic valve lifter including a recessed face on the pin housing for making contact with the a crowned surface region of a roller follower. The lifter includes a pin housing that is slidably disposed within an axial bore in a lifter body. Pins for variably locking the pin housing to the lifter body may be disengaged to place the lifter in lost-motion mode by application of engine oil to the outer ends of the pins. A surface of the pin housing, preferably configured as a dished surface, is formed on the bottom end face of the pin housing that approaches the cam-following lifter roller for making contact with the roller follower's crowned surface region.

6 Claims, 4 Drawing Sheets

VALVE-DEACTIVATING HYDRAULIC LIFTER HAVING A CONTOURED PIN HOUSING BOTTOM SURFACE

TECHNICAL FIELD

The present invention relates to hydraulic lifters for activating valves in response to rotation of a camshaft in an internal combustion engine; more particularly, to such lifters having means for selectively engaging and disengaging such activation; and most particularly, to such a hydraulic valve lifter wherein the pin housing surface facing the roller is reconfigured to prevent damage to the cam-following surface of the roller.

BACKGROUND OF THE INVENTION

It is well known that overall fuel efficiency in a multiple-cylinder internal combustion engine can be increased by selective deactivation of one or more of the engine valves, especially the intake valves, under certain engine load conditions. A known approach to providing selective deactivation is to equip the hydraulic lifters for those valves with means whereby the lifters may be rendered incapable of transferring the cyclic motion of engine cams into reciprocal motion of the associated pushrods. Typically, a deactivation lifter includes, in addition to the conventional hydraulic lash adjuster, concentric inner and outer portions (pin housing and lifter body) which are mechanically responsive to the pushrod and to the cam lobe, respectively, and which may be selectively latched and unlatched to each other, typically by the engagement of pressurized engine oil acting upon one or more spring loaded latching pins extendable from the pin housing into recesses in the lifter body. See, for example, U.S. Pat. Nos. 6,497,207 and 6,814,040, the relevant disclosures of which are incorporated herein by reference.

In prior art deactivating hydraulic valve lifters, when the movement of the locking mechanism is incomplete at the start of a valve lift event, the lifter may start to open the engine valve and then allow it to close rapidly as the partially-engaged locking mechanism is forced, or ejected, from its coupled state between the pin housing and the lifter body. When such an ejection occurs, the valve spring propels the valve toward the valve seat while simultaneously propelling the lifter pin housing toward the lifter cam-following roller. In a typical deactivating valve lifter, the roller surface is crowned so that only a central region of the crown makes rolling contact with the mating cam lobe. The margins of the roller outside of the central region do not make contact with the mating cam roller.

In prior art deactivating hydraulic valve lifters such as disclosed in U.S. Pat. Nos. 6,497,207 and 6,814,040, if ejection occurs from a high lift position of the valve, the pin housing may actually strike the central region of the roller's crowned surface. Such contact of the roller by the pin housing can cause wear and damage (e.g., material spalling, pitting, debris brinelling) to the central region of the crown. Since the central region of the roller's crown runs against a mating surface of the engine's camshaft lobe, damage to the roller may be transferred to the mating camshaft lobe as well; and, since the camshaft is difficult to examine except by a complete engine teardown, costly repairs may result. Hence, it is important to prevent such damage to the central region of the roller's crown.

It is a principal object of the present invention to provide an improved valve-deactivation hydraulic lifter wherein the pin housing is incapable of striking the central region of the crowned surface of the lifter roller that makes contact with the associated cam lobe as a result of a latch ejection.

It is a further object of the invention to prevent damage to an engine camshaft lobe as a result of a latch ejection of a deactivation lifter.

SUMMARY OF THE INVENTION

Briefly described, a valve-deactivation hydraulic valve lifter in accordance with the invention includes a conventional hydraulic lash adjustment disposed conventionally within a pin housing that is slidably disposed within an axial bore in a lifter body. In one example, a transverse bore in the pin housing contains two opposed locking pins urged outwards of the pin housing by a pin-locking spring disposed in compression therebetween to engage a circumferential groove including a locking surface in the lifter body whereby the lifter body and the pin housing are locked together for mutual actuation by rotary motion of the cam lobe to produce reciprocal motion of an engine pushrod disposed in the hydraulic lash means. The pins may be disengaged from the lifter body to place the lifter in lost-motion mode by application of hydraulic fluid such as engine oil to the outer ends of the pins at a pressure sufficient to over come the force of the pin-locking spring.

The invention is directed to a reconfigured surface, preferably a dished recessed surface, on the bottom end face of the pin housing that faces toward the cam-following lifter roller, such that should collision occur between the pin housing and the roller any resulting damage to the roller occurs at the margin of the roller and is outside of the central region of the crowned surface of the roller that makes contact with the mating cam shaft lobe.

BRIEF DESCRIPTION OF THE DRAWINGS

The present invention will now be described, by way of example, with reference to the accompanying drawings, in which.

DESCRIPTION OF THE PREFERRED EMBODIMENTS

Figure 1:
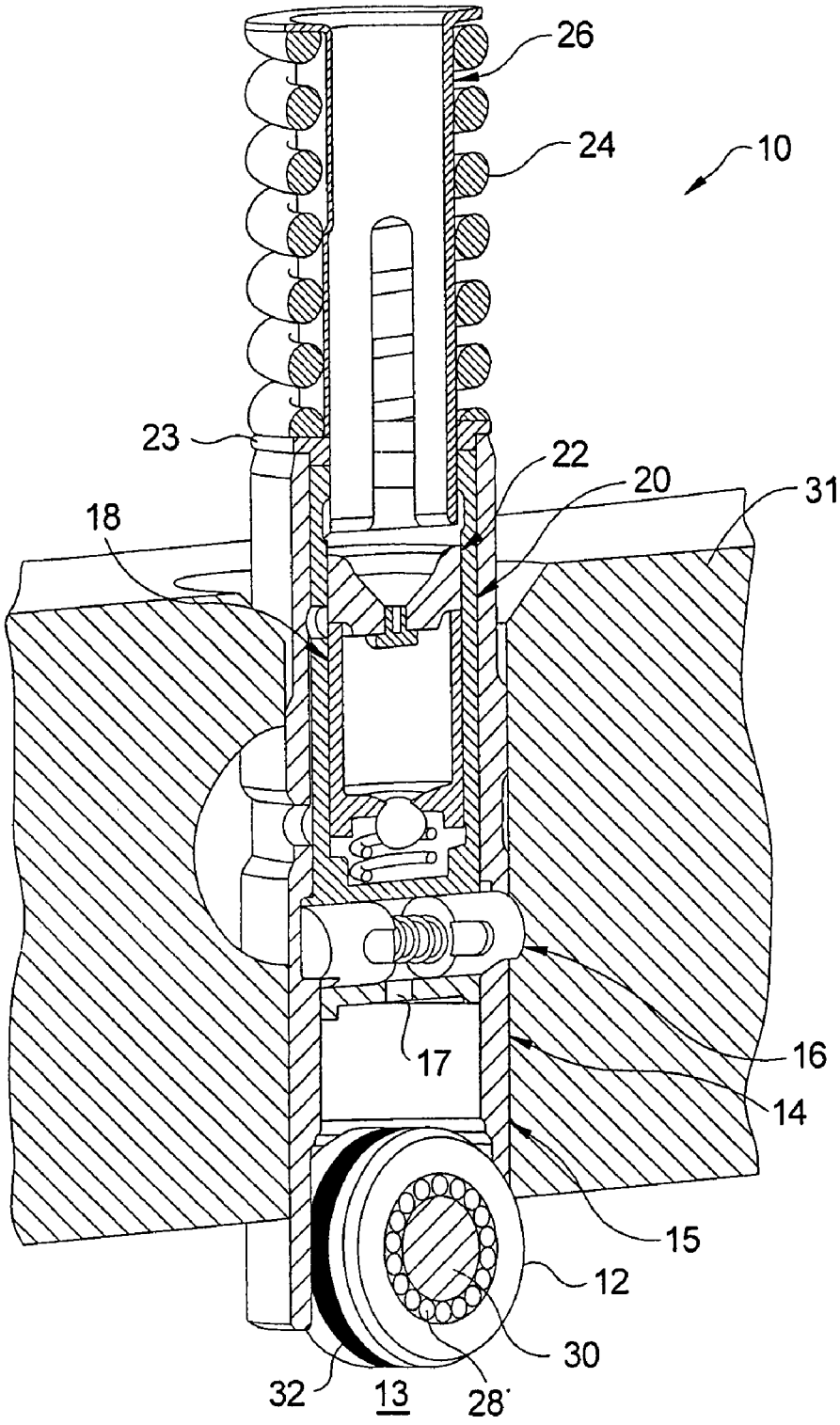
FIG. 1. (PRIOR ART)
FIG. 1 is an oblique cross-sectional elevational view of a prior art valve-deactivating hydraulic lifter.

Referring to FIG. 1, a prior art deactivation roller hydraulic valve lifter (DRHVL) 10 includes roller 12, lifter body 14, deactivation pin assembly 16, plunger assembly 18, pin housing 20, pushrod seat assembly 22, spring seat 23, lost motion spring 24, and spring tower 26.

Plunger assembly 18 is disposed concentrically within pin housing 20, which, in turn, is disposed concentrically within lifter body 14. Pushrod seat assembly 22 is disposed concentrically within pin housing 20 above plunger assembly 18. Roller 12 is associated with lifter body 14. Roller 12 rides on the cam lobe 13 of an internal combustion engine 31 and is displaced vertically thereby. Roller 12 translates the rotary motion of cam lobe 13 to vertical motion of lifter body 14. Deactivation pin assembly 16 latchably engages lifter body 14, thereby transferring the vertical reciprocation of lifter body 14 to pin housing 20 and, in turn, to plunger assembly 18 and pushrod seat assembly 22. Pin housing 16 includes centrally positioned drain hole 17.

In this engaged position, the vertical reciprocation of DRHVL 10 opens and closes a combustion valve (not shown) of internal combustion engine 31. Deactivation pin assembly 16 may be disengaged by applying hydraulic fluid to the ends of the pins to decouple lifter body 14 from pin housing 20 and, in turn, to decouple plunger assembly 18 and pin housing 20 from the vertical reciprocation of lifter body 14. Thus, when deactivation pin assembly 16 is in the disengaged position, only lifter body 14 undergoes vertical reciprocation in lost motion. Drain hole 17 permits hydraulic fluid leaking past the pins to drain from between the pins.

Roller 12 is of conventional construction, having the shape of a crowned cylindrical member within which bearings 28 are disposed and retained. Roller 12 is disposed within a first end 15 of lifter body 14. Shaft 30 passes through roller 12 such that bearings 28 surround shaft 30 and are disposed intermediate of shaft 30 and the inside surface of roller 12. Shaft 30 is attached by, for example, staking to lifter body 14. Lifter body 14 includes on its outside surface anti-rotation flats (not shown) which are aligned with anti-rotation flats on an interior surface of a conventional anti-rotation guide (not shown) within which lifter body 14 of DRHVL 10 is inserted. This assembly 10 is placed in the lifter bore of push-rod type engine 31. Roller 12 rides on cam lobe 13 of push-rod type engine 31, with central region 32 (FIG. 4) of the roller's crowned surface forming a central band around roller 12 for making contact with the cam lobe. Margins of the crowned surface, at each side of the central region, do not make contact with the cam lobe. Roller 12 is constructed of, for example, hardened or hardenable steel or ceramic material.

Figure 4:
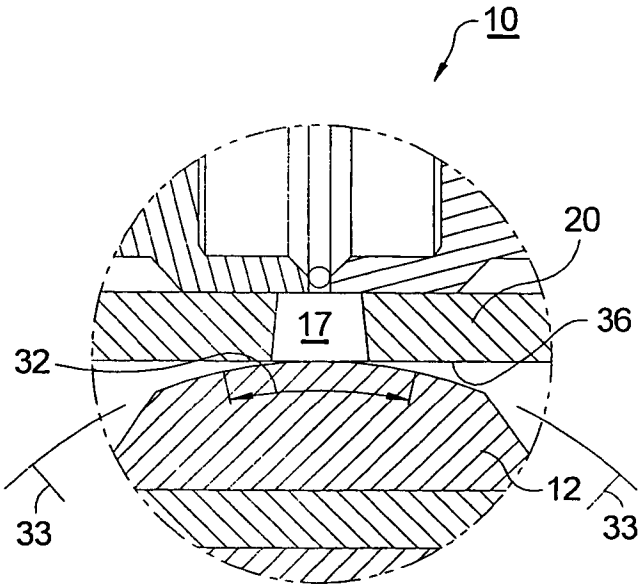
FIG. 4. (PRIOR ART)
FIG. 4 is an enlarged cross-sectional view of a portion of the prior art lifter shown in FIG. 1, showing contact between the planar end of the pin housing and the central region of the crowned surface of the cam-follower roller.
Figure 4A:
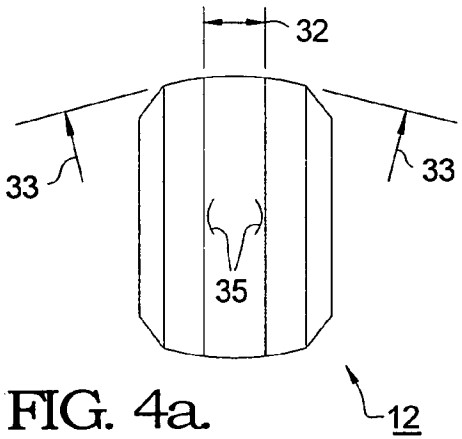
FIG. 4a. (PRIOR ART)
FIG. 4*a* is a bottom view of prior art cam-follower roller shown in FIG. 4, showing the impact pattern from being struck by the pin housing falling within the central region of the crowned surface.

Referring to FIG. 4, an enlarged cross-sectional view of a portion of a prior art DRHVL 10, with radius of curvature 33 of the roller's crowned surface exaggerated for clarity purposes. During a latch ejection, when pin housing 20 strikes roller 12, bottom surface 36 of pin housing 20, and particularly the rimmed edge of drain hole 17, makes contact with central region 32 of the roller's crowned surface. In the prior art, damage to central region 32 in a pattern 35 similar to that shown in FIG. 4*a* is readily incurred by such contact. Since central region 32 of the roller's crown runs against a mating surface of the associated cam shaft lobe, the damaged portion of the roller in the form of pattern 35 is transferred to the cam lobe.

Figure 3:
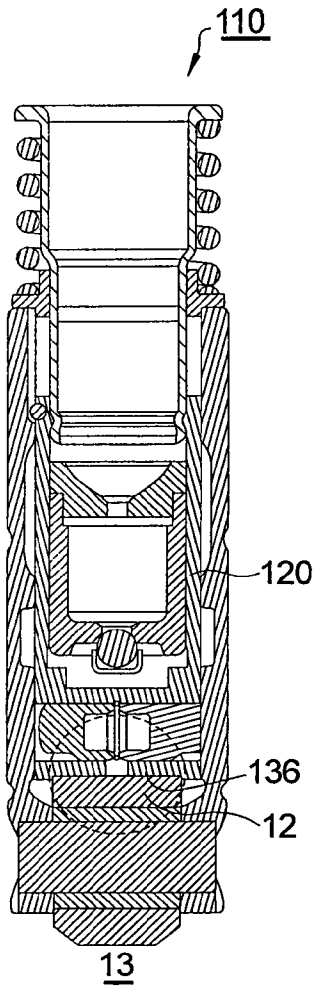
FIG. 3 is a second elevational cross-sectional view of a valve-deactivation hydraulic valve lifter shown in FIG. 2, showing the pin housing in its bottom-most position during a latch ejection event.
Figure 2:
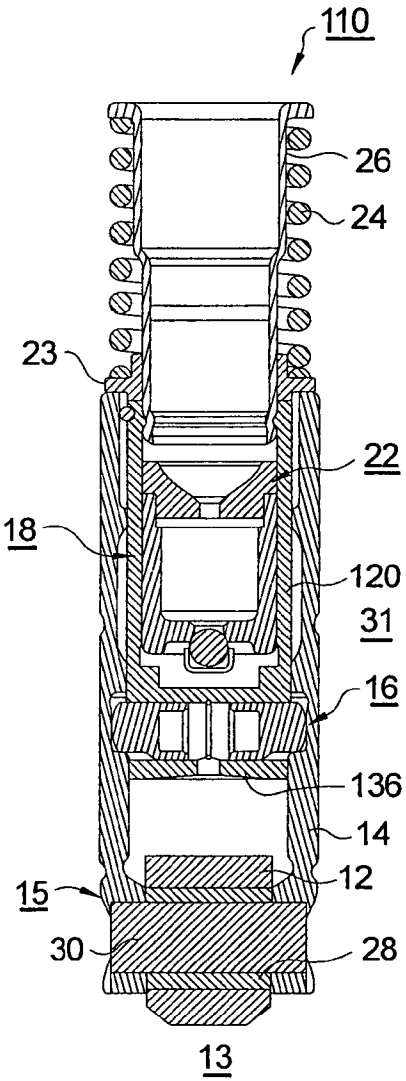
FIG. 2 is a first elevational cross-sectional view of a valve-deactivation hydraulic valve lifter in accordance with the invention, showing the lifter in valve-activation mode.
Figure 5:
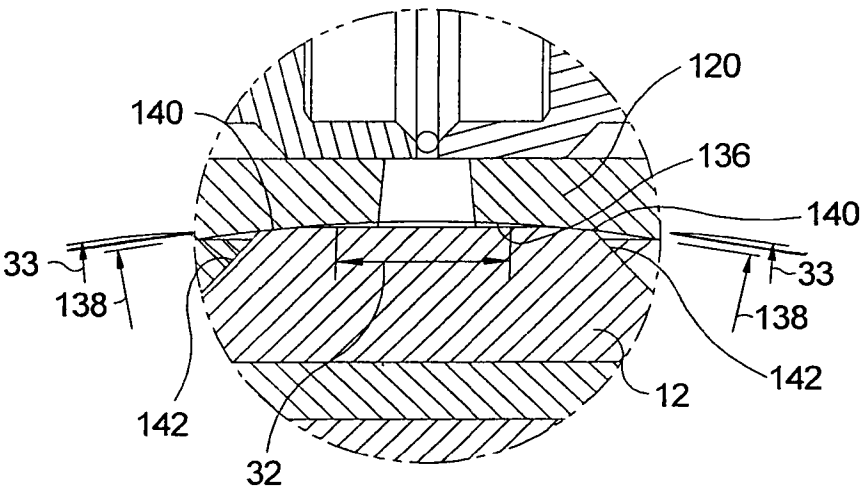
FIG. 5 is an enlarged cross-sectional view of a portion of the improved lifter showing the dished, non-planar end of the pin housing and the resulting lack of contact of the pin housing with the central region of the crowned surface of the cam-follower roller.
Figure 5A:
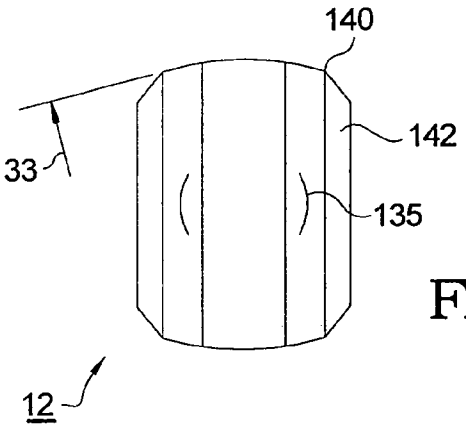
FIG. 5*a* is a bottom view of the cam-follower roller shown in FIG. 5, showing the impact pattern from being struck by the pin housing falling outside the central region of the crowned surface.

Referring now to FIGS. 2, 3, and 5, an improved DRHVL 110 in accordance with the invention is similar in most respects to prior art DRHVL 10, the identical parts being so numbered. In this view, the radius of curvature 33 of the roller's crowned surface is not exaggerated. The improvement lies in the configuration of the bottom surface 136 of the pin housing 120. Prior art surface 36 is planar, whereas improved surface 136 is recessed from planar, preferably dished as shown in detail in FIG. 5. By "dished" is meant that pin housing surface 136 has a radius of curvature 138 less than infinity, the center of the radius of curvature being below the pin housing, as shown. Preferably such curvature extends in all radial directions from the center of the pin housing face, defining thereby a domed recess, rather than being simply in the axial direction of the roller. Also, radius of curvature 138 of surface 136 is less than radius of curvature 33 of the crowned surface of the roller. As such, the points of contact of the pin housing fall outside central region 32 and toward chamfer break 140 of chamfer 142, and pattern 135 is imparted on roller 12 outside of central region 32 as shown in FIG. 5*a*, when impacted by the pin housing.

Such recessing of surface 136 may take any non-planar form that prevents contact from occurring between surface 136 and central region 32 of the crowned roller. When latch ejections occur, the pin housing encounters the roller closer to the chamfer break 140 outside the of central region 32. Further, any peening or distortion of material of roller 12 is displaced outwards toward or into the chamfer 142, thus leaving central region 32 undamaged.

Figure 6A:
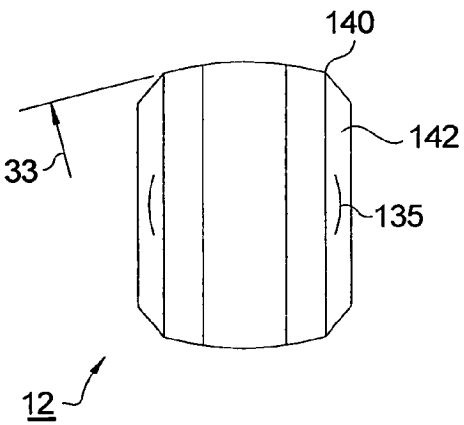
FIG. 6*a* is a bottom view of the cam-follower roller shown in FIG. 6, showing the impact pattern from being struck by the pin housing falling in the chamfered region of the roller.
Figure 6:
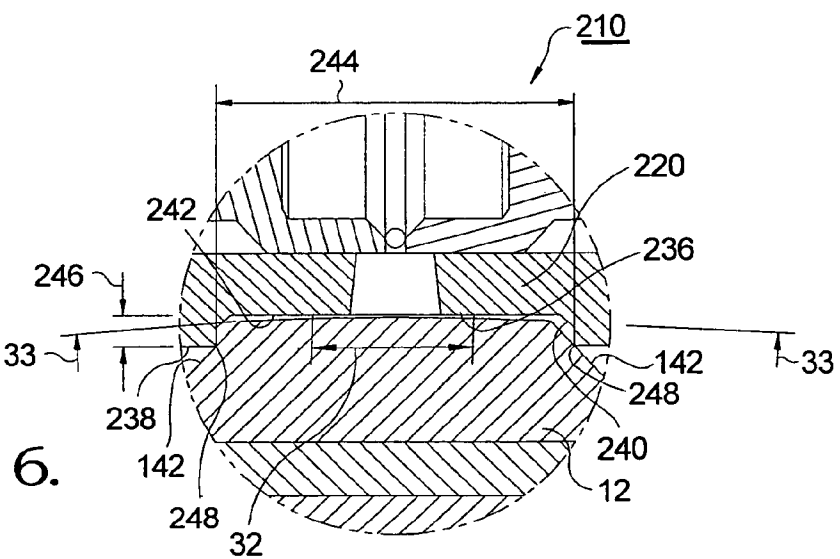
FIG. 6 is an enlarged cross-sectional view of a portion of a alternate embodiment of an improved lifter and the resulting lack of contact of the pin housing with the central region of the crowned surface of the cam-follower roller.

Another embodiment 210 of a non-planar form of the bottom surface of the pin housing is shown in FIG. 6. In the view, radius of curvature 33 of the roller's crowned surface is not exaggerated and central region 32 of the crowned surface is shown. The 1o improvement lies in the configuration of the bottom surface 236 of pin housing 220 including shouldered ridge 238 extending away in a conical slope 240 from recessed surface 242 of pin housing surface 236. In this embodiment, recessed surface 242 may be planar or dished. The diameter 244 and depth 246 of shouldered ridge 238 are selected so that the points of contact 248 of the pin housing fall outside central region 32 and preferable along chamfer 142 of roller 12. As such, the points of contact of the pin housing fall outside central region 32, and particularly in chamfer region 142, and pattern 135 is imparted on roller 12 as shown in FIG. 6*a*, when impacted by the pin housing.

While the invention has been described by reference to various specific embodiments, it should be understood that numerous changes may be made within the spirit and scope of the inventive concepts described. Accordingly, it is intended that the invention not be limited to the described embodiments, but will have full scope defined by the language of the following claims.

What is claimed is:

1. A valve-deactivating hydraulic lifter for selectively coupling the rotary motion of a cam lobe to the reciprocal motion of a valve pushrod in an internal combustion engine, comprising:

a) a lifter body having a roller for following an eccentric surface of said cam lobe, said roller having a central region for contacting said cam lobe, said lifter body having a first axial bore and an axial locking surface formed in a wall of said first axial bore;

b) a pin housing slidably disposed in said first axial bore and having a transverse bore therethrough and having a second axial bore;

c) at least one locking pin slidably disposed in said pin housing transverse bore, said at least one locking pin having an outer end for selectively engaging said axial locking surface to lock said pin housing to said lifter body wherein said pin housing has an axial surface facing the central region of said roller, wherein said axial surface of said pin housing has radius of curvature less than infinity, and wherein said axial surface of said pin housing is configured to avoid contacting said central region.

2. A lifter in accordance with claim 1 wherein said central region is crowned.

3. A lifter in accordance with claim 1 wherein said dished surface is curved in all radial directions from the center of said axial surface of said pin housing.

4. A lifter in accordance with claim 1 wherein said has radius of curvature of said axial surface of said pin housing is a first radius of curvature, wherein said central region has a second radius of curvature, and wherein said first radius of curvature is less than said second radius of curvature.

5. A valve-deactivating hydraulic lifter for selectively coupling the rotary motion of a cam lobe to the reciprocal motion of a valve pushrod in an internal combustion engine, comprising:

a) a lifter body having a roller for following an eccentric surface of said cam lobe, said roller having a central region for contacting said cam lobe and chamfered portions outboard of said central region, said lifter body having a first axial bore and an axial locking surface formed in a wall of said first axial bore;

b) a pin housing slidably disposed in said first axial bore and having a transverse bore therethrough and having a second axial bore;

c) at least one locking pin slidably disposed in said pin housing transverse bore, said at least one locking pin having an outer end for selectively engaging said axial locking surface to lock said pin housing to said lifter body wherein said pin housing has an axial surface facing the central region of said roller, wherein said axial surface of said pin housing is defined by a pin housing surface and a shouldered ridge, wherein said shouldered ridge is configured to make contact with said chamfered portions and wherein said axial surface of said pin housing is configured to avoid contacting said central region.

6. An internal combustion engine having a valve train comprising a valve-deactivating hydraulic lifter for selectively coupling the rotary motion of a cam lobe to the reciprocal motion of a valve, wherein said lifter includes a lifter body having a roller for following an eccentric surface of said cam lobe, said roller having a central region for contacting said cam lobe, said lifter body having a first axial bore and an axial locking surface formed in a wall of said first axial bore, a pin housing slidably disposed in said first axial bore and having a transverse bore therethrough and having a second axial bore, at least one locking pin slidably disposed in said transverse bore, said at least one locking pin having an outer end for selectively engaging said axial locking surface to lock said pin housing to said lifter body, wherein said pin housing has an axial surface facing the central region of said roller, wherein said axial surface of said pin housing has a radius of curvature less than infinity, and wherein said axial surface of said pin housing is in configured to avoid contacting said central region.

* * * * *